US006068534A

United States Patent [19]

Strongin

[11] Patent Number: 6,068,534

[45] Date of Patent: May 30, 2000

[54] BALL WITH A PLURALITY OF MECHANICAL SOUND-PRODUCING DEVICES

[75] Inventor: Ned Strongin, New York, N.Y.

[73] Assignee: HandsOnToys, Inc., Mass.

[21] Appl. No.: 09/231,910

[22] Filed: Jan. 14, 1999

Related U.S. Application Data

[60] Provisional application No. 60/071,407, Jan. 14, 1998.

[51] Int. Cl.[7] ..... A63H 5/00; A63H 3/31

[52] U.S. Cl. ..... 446/213; 446/397; 446/188; 446/203; 446/218

[58] Field of Search ..... 446/397, 175, 446/188, 213, 218, 203

[56] References Cited

U.S. PATENT DOCUMENTS

| | | | |
|---|---|---|---|
| 1,709,841 | 4/1929 | Da Costa . | |
| 2,538,120 | 1/1951 | Nakano | 46/61 |
| 3,935,669 | 2/1976 | Potrzuski, et al. | 46/226 |
| 4,750,745 | 6/1988 | Benham | 446/188 |
| 5,112,055 | 5/1992 | Barnhill | 273/213 |
| 5,133,551 | 7/1992 | Handy et al. | 273/72 |
| 5,590,875 | 1/1997 | Young | 473/457 |

*Primary Examiner*—Sam Rimell

*Attorney, Agent, or Firm*—Nields, Lemack & Dingman; Brian M. Dingman

[57] ABSTRACT

A toy ball which emits sounds as it is rolled, comprising: a ball body; and a plurality of mechanically-operated sound tubes carried within the ball body, each sound tube including a sliding whistle which moves along the tube by the force of gravity, and each sound tube lying along a longitudinal axis, in which the axes are transverse to one another, so that the sound tubes emit sound when the ball is moved along various axes.

11 Claims, 1 Drawing Sheet

BALL WITH A PLURALITY OF MECHANICAL SOUND-PRODUCING DEVICES

CROSS REFERENCE TO RELATED APPLICATION

This application is a continuation in part of copending Provisional Application Ser. No. 60/071,407, filed on Jan. 14, 1998.

FIELD OF THE INVENTION

This invention relates to toy balls which make sound when they are moved. The sound is produced by a plurality of devices embedded in the ball, each of which mechanically produces sound as the ball moves. The ball thus does not require a battery power source.

BACKGROUND OF THE INVENTION

A hollow plastic baseball with external openings to allow air flow therethrough (a WHIFFLE type ball) carrying a single sound-producing tube (hereinafter a "sound tube"), is disclosed in U.S. Pat. No. 5,590,875. The subject ball includes a single sound tube, and sound is produced by the tube only when the sliding whistle is moved along the tube by gravity, or by the forces involved in throwing the ball. Accordingly, the ball will emit noise only when the tube is properly oriented relative to the ground, or thrown in a manner to create movement of the sliding whistle. The result is that the ball will only emit substantial amounts of sound if it is handled purposefully so as to create the sound. However, such particular handling requirements defeats the purpose of a ball, which is to allow free play therewith. Accordingly, that ball is unsatisfactory for a play ball which emits playful or fanciful sounds.

SUMMARY OF THE INVENTION

The sound-producing devices used in this invention preferably include a movable member which is moved by gravity as the orientation of the member changes by reason of movement of the ball. These sound-producing devices may be oriented such that the movement of the movable members of the devices occurs along transverse axes, which increases the likelihood of sound occurrence, regardless of the manner in which the ball is moved. For example, three sound-producing devices can be arranged along substantially orthogonal axes, which ensures that sound will be produced upon virtually any rolling motion of the ball.

This invention features a toy ball which emits sounds as it is rolled, comprising: a ball body; and a plurality of mechanically-operated sound tubes carried within the ball body, each sound tube including a sliding whistle which moves along the tube by the force of gravity, and each sound tube lying along a longitudinal axis, in which the axes are transverse to one another, so that the sound tubes emit sound when the ball is moved along various axes.

In a preferred embodiment, there are three said sound tubes, and the three axes are orthogonal. The ball is preferably generally spherical with six indented areas, and the ends of each sound tube are located at the ball surface in an indented area, to inhibit the sound tubes from contacting a surface against which the ball is contacted.

Preferably, the sound tubes are entirely embedded within the ball body, and the ends of each sound tube are exposed to free air. The ball body may be hollow, and made from a pliable material. In that case, the ball may further include means for tightly holding the ends of each sound tube proximate the surface of the ball body, which may be accomplished with a lip formed in the ball body, which partially overlays the end of each sound tube. The lip may lie below the apparent surface of the ball body, to inhibit the ends of the tubes from contacting a surface against which said ball is contacted.

In a preferred embodiment, this invention features a toy ball which emits sounds as it is rolled, comprising: a generally spherical ball body; and three substantially orthogonal mechanically-operated sound tubes carried within said ball body, each said sound tube including a sliding whistle which moves along said tube by the force of gravity, and each said sound tube lying along a longitudinal axis, in which said axes are substantially orthogonal to one another, so that said sound tubes emit sound when said ball is moved along various axes; wherein said ball body includes six indented areas, and in which the ends of each said sound tube are located at the ball surface in an indented area, to inhibit the sound tubes from contacting a surface against which said ball is contacted.

In a more specific embodiment, this invention features a toy ball which emits sounds as it is rolled, comprising: a generally spherical, hollow ball body made from a pliable material; and three substantially orthogonal mechanically-operated sound tubes carried within said ball body, each said sound tube including a sliding whistle which moves along said tube by the force of gravity, and each said sound tube lying along a longitudinal axis, in which said axes are substantially orthogonal to one another, so that said sound tubes emit sound when said ball is moved along various axes; wherein said ball body includes six indented areas, and in which the ends of each said sound tube are located at the ball surface in an indented area, to inhibit the sound tubes from contacting a surface against which said ball is contacted;

Wherein said ball body includes a lip below its apparent surface, said lip partially overlaying the ends of each said sound tube, to tightly hold the ends of said sound tubes proximate said surface at said indented areas.

BRIEF DESCRIPTION OF THE DRAWINGS

Other objects, features and advantages will occur to those skilled in the art from the following description of the preferred embodiment, and the accompanying drawings, in which.

DESCRIPTION OF THE PREFERRED EMBODIMENT

Figure 1:
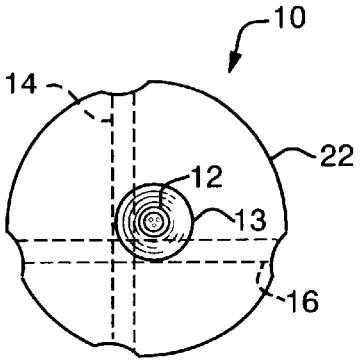
FIG. 1 is a side view of the preferred embodiment of the toy ball of this invention.
Figure 2:
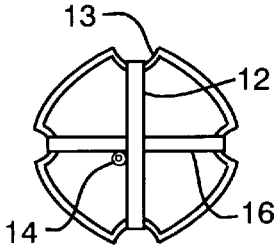
FIG. 2 is a cross-sectional view of the ball of FIG. 1.

There is shown in FIG. 1, toy ball 10 according to this invention. Ball 10 includes plastic ball body 22, which can be made hollow or solid, as desired. Shown in the drawings is a body 22 which is rotatably molded of a relatively soft PVC plastic material, about 2 mm thick.

Ball 10 includes three identical mechanical sound-producing devices 12, 14 and 16. Devices 12, 14, and 16 are hollow tubes with sliding cylindrical whistles (such as whistle 40, FIG. 3), which produce sound with a reed through which air passes as the whistle slides along the tube. Sound-producing devices of this type are depicted in U.S. Pat. No. 5,590,875. In the preferred embodiment shown in the drawings, the tubes of devices 12, 14 and 16 lie along substantially orthogonal axes (within the tolerances required in rotational molding of a ball such as this), although this invention contemplates two or more of any kind of mechanical sound producing devices arranged such that the sound producing movement of the devices occurs along transverse, as opposed to parallel, axes. There is no limitation to sound tubes as the mechanical sound producing devices or to the arrangement of the sound producing devices. The transverse arrangement increases the likelihood of sound occurrence, regardless of the motion of the ball with respect to the axis of the movement of the movable member of any one particular sound-producing device.

Figure 3:
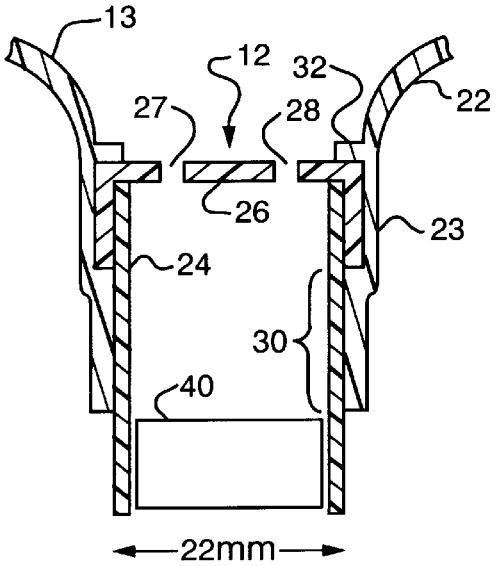
FIG. 3 is an enlarged, partial, cross-sectional view of a sound producing device and the manner in which it is secured in the preferred embodiment of the ball of this invention.

The end of each sound tube is preferably located below the extended spherical ball surface (i.e., the surface the ball would have if it did not include conical depressions), so that the ball can bounce properly. Thus, ball body 22 has a depression 13 (preferably conical) leading from the spherical surface of body 22 down to the exposed end of device 12. The preferred manner in which the tubes are held in the ball is shown in FIG. 3. Sound tube 12 includes tube 24 with end-cap 26 secured with adhesive across the open end of tube 24. Tube 24 and cap 26 are also made of PVC. Cap 26 has holes 27, 28, which allow movement of air into and out of tube 24, and also allow sound produced by sliding whistle 40 to escape from tube 24.

Ball body 22 is made from a relatively soft PVC plastic material, preferably by rotational molding. Lip 32 is formed in body 22, to partially overlay cap 26, which helps to maintain sound tube 12 within ball body 22. Ball body 22 also has inwardly protruding tubular section 23, which is sized and shaped to very tightly fit over sound tube 12, as shown in the drawing. To assist in maintaining sound tube 12 in body 22, an adhesive can be applied to tube 24 in area 30, to bond body 22 to tube 24. This also helps to maintain positive air pressure within ball body 22, if such is desired. These features together comprise the preferred means to tightly hold the ends of the sound tubes proximate the surface of the ball body.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A toy ball which emits sounds as it is rolled, comprising:

a ball body; and a plurality of mechanically-operated sound producing devices carried within said ball body, each said sound producing device including a member which moves by the force of gravity, and each said sound producing device lying along a longitudinal axis, in which said axes are transverse to one another, so that said sound producing devices emit sound when said ball is moved along various axes.

2. The toy ball of claim 1, in which each said sound producing device is a sound tube with a sliding whistle, in which said toy ball includes three said sound tubes.

3. The toy ball of claim 2 in which said axes are substantially orthogonal.

4. The toy ball of claim 2 in which said ball is generally spherical with six indented areas, and in which the ends of each said sound tube are located at the ball surface in an indented area, to inhibit the sound tubes from contacting a surface against which said ball is contacted.

5. The toy ball of claim 1 in which said sound producing devices are entirely embedded within said ball body, and in which the ends of each said sound producing device are exposed to free air.

6. The toy ball of claim 1 in which said ball body is hollow, and is made from a pliable material.

7. The toy ball of claim 6, further including means for tightly holding the ends of each said sound producing device proximate the surface of said ball body.

8. The toy ball of claim 7 in which said means for tightly holding includes a lip formed in said ball body, which partially overlays the end of said sound producing device.

9. The toy ball of claim 8, in which said lip lies below the apparent surface of said ball body, to inhibit the ends of said sound producing devices from contacting a surface against which said ball is contacted.

10. A toy ball which emits sounds as it is rolled, comprising:

a generally spherical ball body; and three substantially orthogonal mechanically-operated sound tubes carried within said ball body, each said sound tube including a sliding whistle which moves along said tube by the force of gravity, and each said sound tube lying along a longitudinal axis, in which said axes are substantially orthogonal to one another, so that said sound tubes emit sound when said ball is moved along various axes; wherein said ball body includes six indented areas, and in which the ends of each said sound tube are located at the ball surface in an indented area, to inhibit the sound tubes from contacting a surface against which said ball is contacted.

11. A toy ball which emits sounds as it is rolled, comprising:

a generally spherical, hollow ball body made from a pliable material; and three substantially orthogonal mechanically-operated sound tubes carried within said ball body, each said sound tube including a sliding whistle which moves along said tube by the force of gravity, and each said sound tube lying along a longitudinal axis, in which said axes are substantially orthogonal to one another, so that said sound tubes emit sound when said ball is moved along various axes; wherein said ball body includes six indented areas, and in which the ends of each said sound tube are located at the ball surface in an indented area, to inhibit the sound tubes from contacting a surface against which said ball is contacted;

Wherein said ball body includes a lip below its apparent surface, said lip partially overlaying the ends of each said sound tube, to tightly hold the ends of said sound tubes proximate said surface at said indented areas.

* * * * *